US006518694B1

(12) United States Patent
Rossi

(10) Patent No.: US 6,518,694 B1
(45) Date of Patent: Feb. 11, 2003

(54) STUD FOR CATHODE RAY TUBE FACE PANEL

(75) Inventor: Juan Rossi, York, PA (US)

(73) Assignee: Osram Sylvania Inc., Danvers, MA (US)

( * ) Notice: Subject to any disclaimer, the term of this patent is extended or adjusted under 35 U.S.C. 154(b) by 225 days.

(21) Appl. No.: 09/643,528

(22) Filed: Aug. 22, 2000

Related U.S. Application Data

(60) Provisional application No. 60/154,133, filed on Sep. 15, 1999.

(51) Int. Cl.[7] ..... H01J 29/07; H01J 29/81; H01J 29/82

(52) U.S. Cl. ..... 313/406; 313/402; 313/404; 313/407; 313/408

(58) Field of Search ..... 313/402, 404, 313/406, 405, 407

(56) References Cited

U.S. PATENT DOCUMENTS

| | | | | |
|---|---|---|---|---|
| 3,004,182 A | * | 10/1961 | Pfaender | 313/317 |
| 3,379,913 A | | 4/1968 | Gannoe | 313/85 |
| 4,644,222 A | | 2/1987 | Brunn | 313/406 |
| 4,730,142 A | | 3/1988 | Brunn | 313/402 |
| 4,755,713 A | | 7/1988 | Wagenknecht et al. | 313/406 |
| 4,763,039 A | | 8/1988 | Van Rens et al. | 313/406 |
| 4,812,705 A | * | 3/1989 | Wagenknecht et al. | 313/402 |
| 4,829,212 A | * | 5/1989 | Serio et al. | 313/406 |
| 4,866,333 A | * | 9/1989 | Tokita et al. | 313/404 |
| 4,868,453 A | | 9/1989 | Van Rens et al. | 313/402 |
| 4,987,337 A | | 1/1991 | Bongenaar et al. | 313/406 |

* cited by examiner

*Primary Examiner*—Vip Patel
*Assistant Examiner*—Sikha Roy
(74) *Attorney, Agent, or Firm*—William H. McNeill

(57) ABSTRACT

A stud for mounting a shadowmask in a cathode ray tube comprises a tubular body symmetrically arrayed about a longitudinal axis and having a given diameter and a spherical projection fixedly mounted upon one end of the tubular body. The sphere has a diameter greater than the given diameter. In alternate embodiments the tubular body can have plural diameters.

5 Claims, 5 Drawing Sheets

STUD FOR CATHODE RAY TUBE FACE PANEL

This application claims priority from Provisional Application No.: 60/154,133, filed Sep. 15, 1999.

TECHNICAL FIELD

This invention relates to shadowmask supporting studs for cathode ray tubes.

BACKGROUND ART

Face panels for some cathode ray tubes, particularly those used to display images in color, include a frontal portion having a peripheral wall upstanding therefrom. The frontal or viewing portion generally comprises a spherical, cylindrical or flat section, defining a generally flat plane. The upstanding wall of such face panels has a plurality of studs retained therein for supporting a shadow mask or color-selecting electrode. These tubes generally employ three or four studs spaced 120° to 90° apart, respectively. Studs, which have been frequently employed in the past, are shown in U.S. Pat. Nos. 3,379,913, and 4,755,713.

Newer styles of CRT's, such as those now used for color television or computer monitors, have more nearly square corners than older types and have employed different types of studs. Primary among these newer types are those using a base member for embedment into the glass wall of the tube together with a spherical projection for engaging a spring member mounted upon the shadow mask. Such studs are shown, for example, in U.S. Pat. Nos. 4,644,222; 4,987,337; 4,868,453; 4,763,039; and 4,730,142, and utilize bases that can be solid or hollow and cup-shaped. The spherical projection can be formed in the material or, as more likely, welded to a previously formed stud. In the former technique shaping the ball end adds considerable cost. The latter technique requires forming the face of the stud to a configuration matching that of the sphere to be attached, usually by cold-working the material without fracturing it or, in the case of a solid base, accurately positioning and holding the sphere while welding or other suitable attachment takes place. See in particular U.S. Pat. No. 4,868,453. While all of these various studs have been used with some success, problems have existed, not only with regard to cost, but also by causing interference with non-destructive-testing procedures (NDT), such as eddy-current testing which can be difficult if the weld bead holding the sphere to the body is less than 360°.

DISCLOSURE OF INVENTION

It is, therefore, an object of the invention to obviate the disadvantages of the prior art.

It is another object of the invention to enhance CRT studs.

These objects are accomplished, in one aspect of the invention, by the provision of a CRT stud for mounting a shadowmask which stud comprises a tubular body symmetrically arrayed about a longitudinal axis. The body has a first end having a first diameter formed to engage a wall of the cathode ray tube and has a second end formed to receive a sphere. The sphere has a diameter larger than that of the body. In a preferred embodiment the stud comprises a tubular body symmetrically arrayed about a longitudinal axis. The body has a first portion formed to engage a wall of the cathode ray tube and a first diameter and a second portion extending therefrom, the second portion having a second diameter smaller than said first diameter. As used herein the term tubular refers to a more or less cylindrical, hollow construction that is open at both ends. By making the stud tubular, the step of forming the face of the stud to match the diameter of the sphere is eliminated. The cost is reduced and welding becomes easier, as does NDT.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
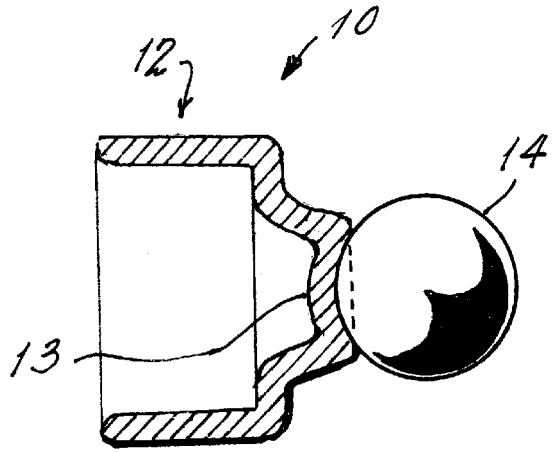
Fig. 1 Prior Art
FIG. 1 is an elevational view, partially in section, of a prior art stud.
Figure 2:
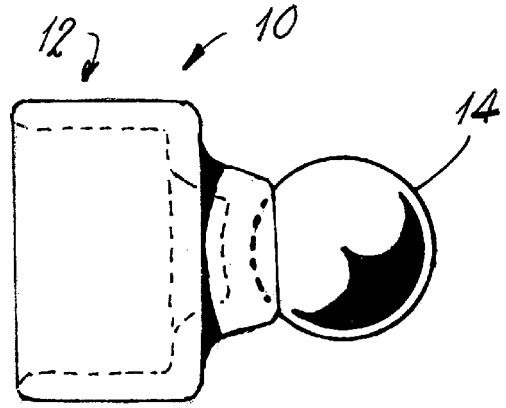
Fig. 2 Prior Art
FIG. 2 is an elevational view of the stud of FIG. 1.

Referring now to the drawings with greater particularity, there is shown in FIGS. 1 and 2 a prior art CRT stud 10 having a body 12 and projecting sphere 14. Body 12 is cup-shaped and has a closed end 13 that has been configured, as by cold-working, into a concave receptacle matching the curvature of sphere 14. Sphere 14 is affixed, as by welding, to the body 12 to complete the stud. Body 12 is usually formed by deep-drawing in a transfer press.

Figure 3:
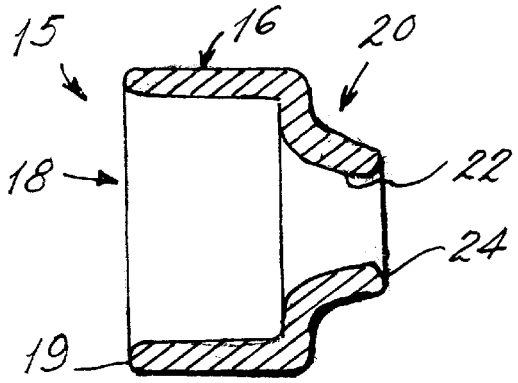
FIG. 3 is a sectional, elevational view of a stud embodying an aspect of the invention.
Figure 4:
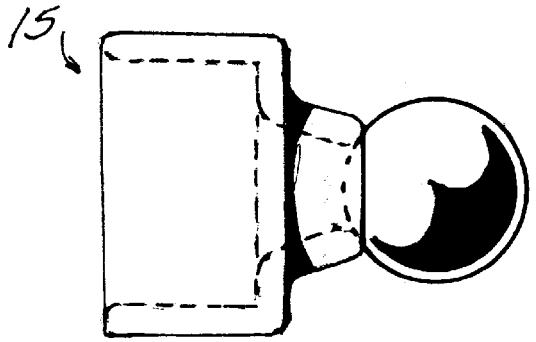
FIG. 4 is an elevational view of the stud of FIG. 3.
Figure 5:
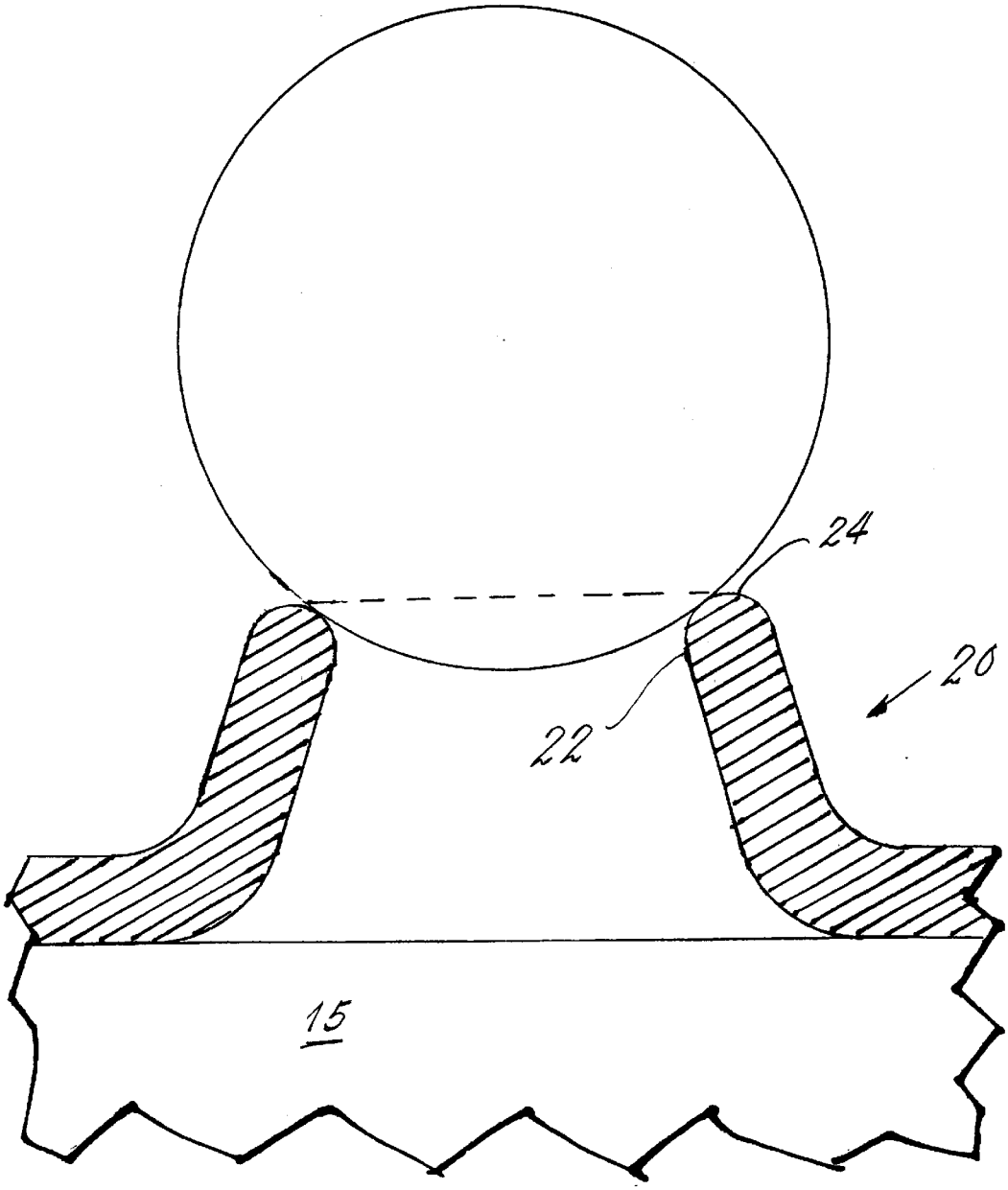
FIG. 5 is a partial elevational view, partly in section of an embodiment of the invention.
Figure 6:
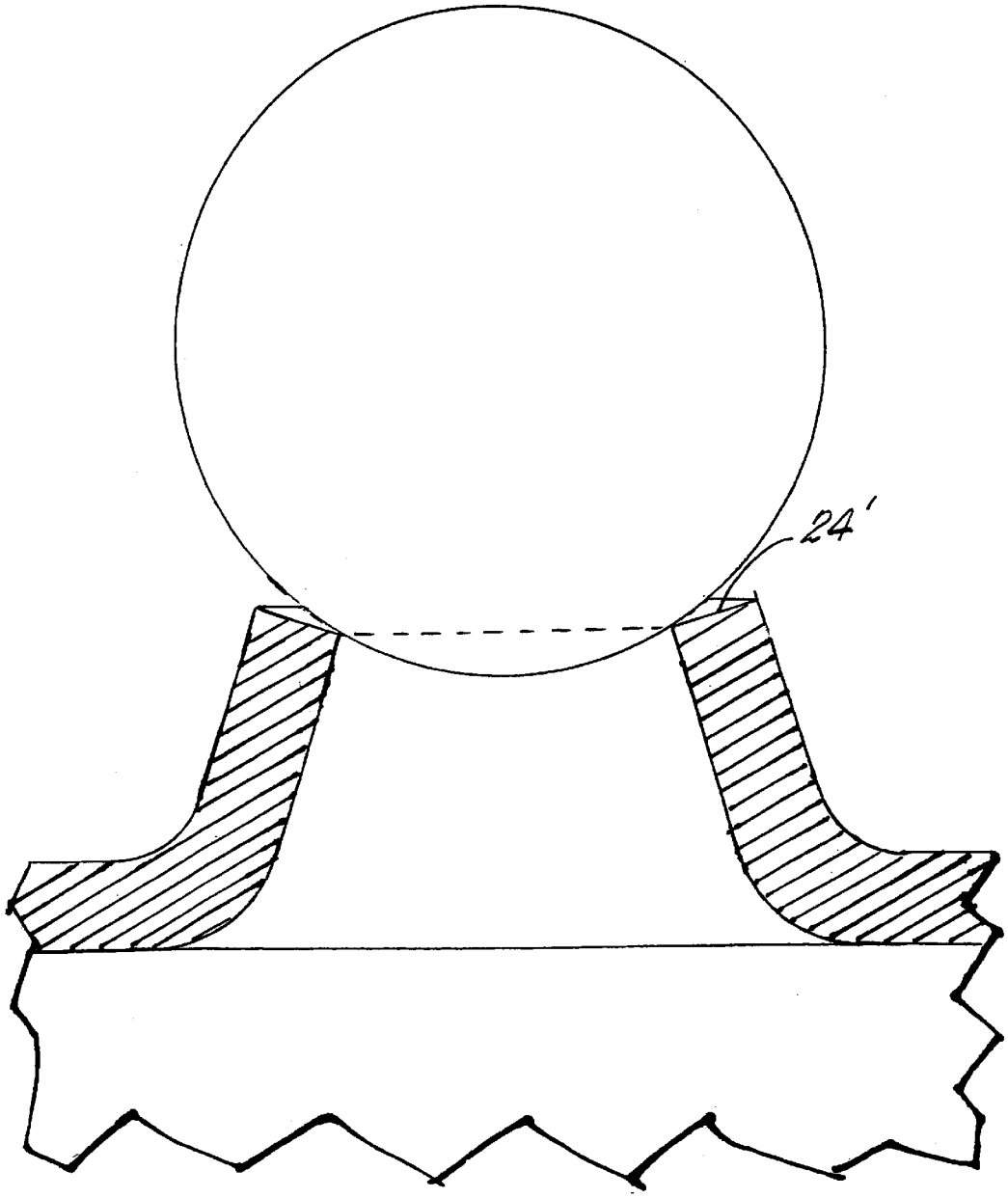
FIG. 6 is a similar view of an alternate embodiment of the invention.

FIGS. 3 and 4 display a CRT stud according to an embodiment of the invention. Herein the stud 15 comprises a tubular body 16 symmetrically arrayed about a longitudinal axis. As noted hereinbefore, as used herein tubular means open at both ends. The body 16 in this instance has a first portion 18 with an edge 19 formed to engage a wall of a cathode ray tube. The first portion 18 has a first diameter. A second portion 20 extends therefrom and has a second diameter, formed by a throat 22, which second diameter is smaller than the first diameter and, of course, smaller than the diameter of the sphere to be applied thereto. The second portion can be cylindrical or frusto-conical, as shown. The terminal edge 24 of the stud can be rounded-over to receive the sphere by tangential contact as shown in FIG. 4 and in an enlarged view, FIG. 5. Alternatively, tangential contact can be obtained by keeping a terminal edge 24' normal to the sidewall, as shown in FIG. 6. If greater contact between the edge and the sphere is desired a terminal edge 24" can be shaped to conform to the surface of the sphere, as is shown in FIG. 7.

Figure 7:
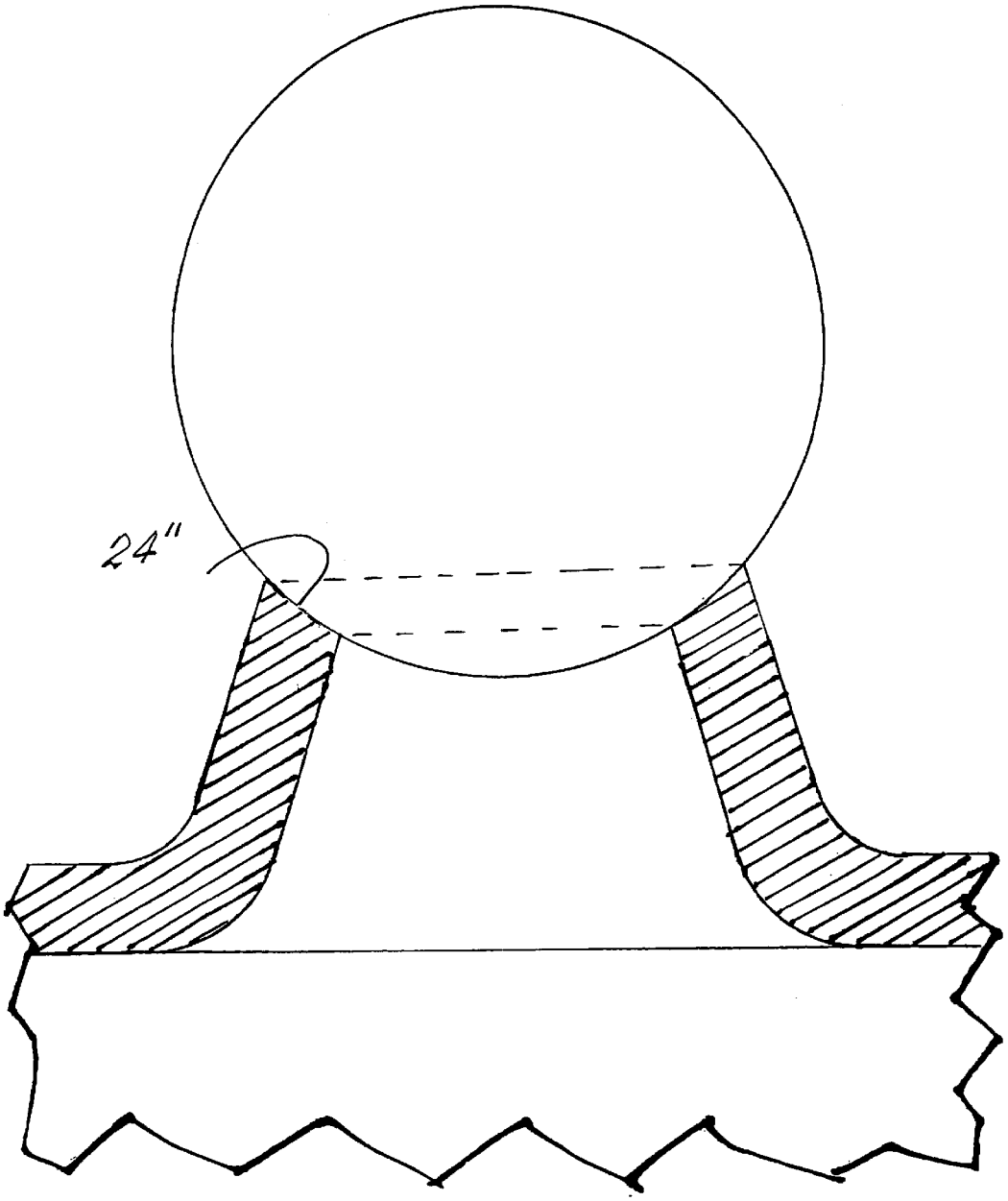
FIG. 7 is a similar view of another embodiment of the invention.

The studs shown in the embodiments of FIGS. 4, 6 and 7 represent a double-diametered configuration having had great success in the past. Such studs can be formed from tubular stock with the second portion being necked down.

Figure 8:
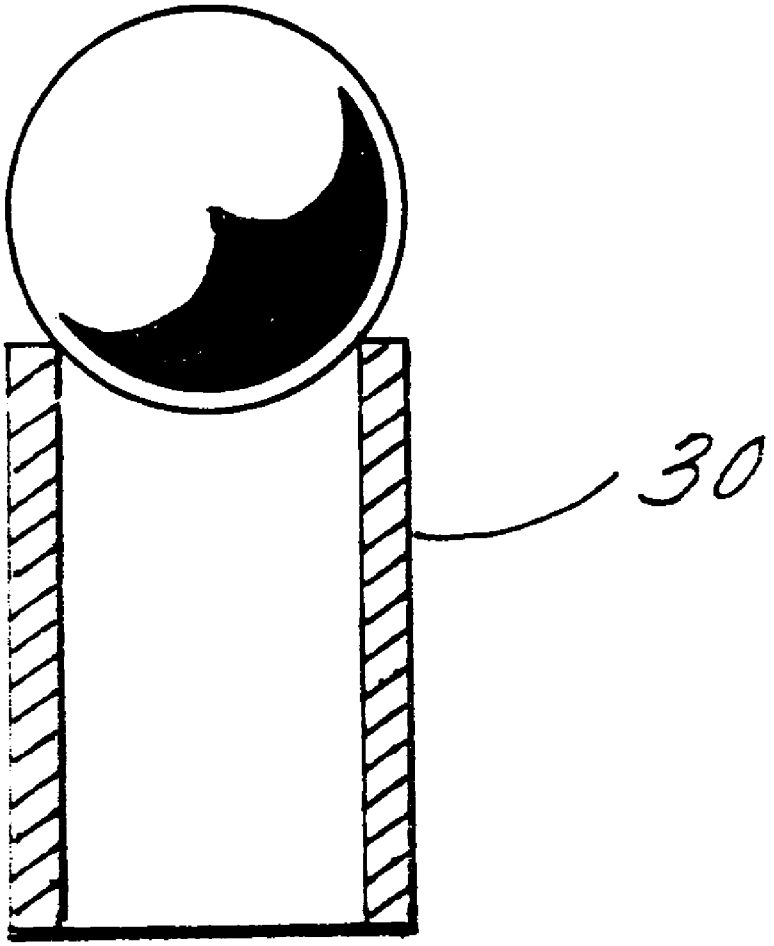
FIG. 8 is an elevational view, partly in section, of yet another embodiment of the invention.

The embodiment shown in FIG. 8, however, represents the invention in its simplest form wherein a tubular body 30 has but a single diameter. Such a stud can take the place of solid bodies like those shown in FIG. 2 of U.S. Pat. No. 4,868,453. Placement of the sphere and fixation to the body is greatly simplified by the utilization of the tubular body. Likewise, the cost is reduced for all of the tubular stud bodies described herein and the elimination of the cold-working step to form the concave upper surface prevents unwanted work stresses from developing in the material.

Preferably the studs are formed from a suitable stainless steel alloy which can be oxidized to seal with the glass of the CRT face panel. Suitable materials include Number 4 alloy, a nickel-iron-chrome material available from Osram Sylvania Inc., Warren, Pa.; and 430 Ti stainless steel, a chrome-iron alloy produced by Allegheny Ludlum Corp., Pittsburgh, Pa.

While there have been shown and described what are at present considered the preferred embodiments of the invention, it will be apparent to those skilled in the art that various changes and modifications can be made herein without departing from the scope of the invention as defined by the appended claims.

What is claimed is:

1. A stud for mounting a shadowmask in a cathode ray tube, said stud comprising:

a tubular body symmetrically arrayed about a longitudinal axis;

said body having a first portion formed to engage a wall of said cathode ray tube and a first diameter and a second portion extending therefrom, said second portion having a second diameter smaller than said first diameter.

2. The stud of claim 1 wherein said second portion is frusto-conical.

3. The stud of claim 1 wherein said second portion is surmounted by a sphere having a diameter larger than said second diameter and smaller than said first diameter.

4. The stud of claim 3 wherein said second portion has an inner edge and said inner edge is formed to be contiguous with an area of said sphere.

5. A stud for mounting a shadowmask in a cathode ray tube, said stud comprising:

a tubular body symmetrically arrayed about a longitudinal axis and having a given diameter;

and a spherical projection fixedly mounted upon one end of said tubular body, said sphere having a diameter greater than said given diameter.

* * * * *